United States Patent [19]

Viessmann

[11] 4,294,198

[45] Oct. 13, 1981

[54] HEATING BOILER FOR LIQUID OR GASEOUS FUELS

[76] Inventor: Hans Viessmann, Im Hain, 3559 Battenberg, Eder, Fed. Rep. of Germany

[21] Appl. No.: 7,886

[22] Filed: Jan. 31, 1979

[30] Foreign Application Priority Data

Feb. 4, 1978 [DE] Fed. Rep. of Germany ..... 2804780
Dec. 27, 1978 [DE] Fed. Rep. of Germany ..... 2856061

[51] Int. Cl.[3] ..... F22B 7/00
[52] U.S. Cl. ..... 122/136 R; 122/52
[58] Field of Search ..... 122/135, 136, 155, 160, 122/161, 511, 51, 52; 431/353; 126/360 R

[56] References Cited

U.S. PATENT DOCUMENTS 2,638,878 5/1953 Lemos, Jr. et al. ..... 122/136 C
4,169,431 10/1979 Viessmann ..... 122/136 R

FOREIGN PATENT DOCUMENTS 148734 10/1952 Australia ..... 122/136 C
2620168 3/1978 Fed. Rep. of Germany ... 122/136 R
1324776 3/1963 France ..... 122/136 R

*Primary Examiner*—Edward G. Favors
*Attorney, Agent, or Firm*—Posnack, Roberts, Cohen & Spiecens

[57] ABSTRACT

A heating boiler is provided which includes a water jacket including front and rear walls with fuel flues being employed in the boiler. A tube is provided which extends through the water jacket and extends through the front and rear walls and encloses the aforesaid flues as well as defining a combustion chamber and a collecting chamber. A sleeve is provided in the vicinity of the collecting chamber and the tube and sleeve are in such a relationship that one encircles the other. A gap is defined between the tube and sleeve at least one of which is provided with a bulge adjacent the gap to increase the size of the gap between the tube and sleeve. The outermost of the tube and sleeve members is connected in a thermally conductive manner with the rear wall of the water jacket, and a closure is provided with respect to either the tube or the sleeve to obturate the collecting chamber. In one embodiment, the sleeve encircles the tube, and, in another embodiment, the tube encircles the sleeve. One or both of these members may be provided with a bulge. In one embodiment of the invention, a thermally conductive connection is provided between the peripheral edge of the sleeve remote from the rear wall of the water jacket and the tube. The connection may otherwise be a contacting engagement capable of thermal conductivity. The flues in one embodiment of the invention are provided with slots to receive the sleeve and support the same.

3 Claims, 5 Drawing Figures

HEATING BOILER FOR LIQUID OR GASEOUS FUELS

FIELD OF INVENTION

The invention relates to a heating boiler for liquid or gaseous fuels, consisting of a water jacket in which there is arranged a tube which passes through the front and rear walls of the water jacket and which surrounds the combustion chamber, fuel-gas flues and collecting chamber and whose peripheral edge on the outlet side has a closure with a flue-gas connection and which is provided in the region of the collecting chamber with a sleeve preventing heat transmission.

BACKGROUND

Heating boilers of the above-mentioned type are known from German Offenlegungsschrift No. 23 13 186, especially with regard to the sleeve in the region of the flue-gas collecting chamber.

The combustion gases have, as is known, the lowest temperature at the boiler end. If the temperature of the boiler wall lies below 65° C., the combustion gases condense upon combustion of oil or gas. With oil, an acid condensate forms, consisting of sulphurous acid or sulphuric acid which strongly attacks the iron materials and finally destroys them in course of time. Owing to the expensiveness of heating energy, it is necessary to save heating energy. This is to be achieved, among other things, by heating the boiler only when heat is required; that should be, the boiler is operated not at constant and elevated temperature, but at so-called sliding temperature and can cool off from time to time. If the boiler is not protected sufficiently against corrosion by special measures, acid condensate is formed upon reheating and there is consequently a risk of corrosive attack.

It is most appropriate to make the heating boiler dry, or in other words, to design as large a part as possible of the heating faces in such a way that also at low boiler water temperature they assume, immediately after the burner is switched on, a temperature which lies above the dew-point temperature of the combustion gases. Combustion gases can then not condensate at all and cause damage.

With the known heating boiler, this is achieved by making the heating boiler cylindrical, U-shaped profiles being welded on the inside as fuel-gas flues. These U-shaped profiles assume, immediately after the oil burner has been switched on, a higher temperature or a sufficiently high temperature to prevent combustion gases from condensing. In front of the flues in the region of the guide chamber, the radiant heat of the flame is so high that the combustion gases do no condense or evaporate again immediately. Behind the flues in the region of the collecting chamber, the arrangement of a sleeve preventing heat transmission has been successful, but it has proved necessary to improve the sleeve with regard to manufacturing costs.

SUMMARY OF INVENTION

An object of the invention is therefore to improve a heating boiler of the above-mentioned type, especially in the region of the collecting chamber, in respect of its effectiveness in the reliable prevention of condensate formation and in respect of a more favorable method of manufacture.

This object can be achieved in various ways. A first solution consists in that in the upper region of the tube, for example, resting thereon, the sleeve is arranged eccentrically on the tube to form a lower gap and its peripheral edge remote from the outlet is connected to the tube in a liquid tight manner and the closure plate is welded to the peripheral edge of the tube in a heat-conducting manner.

A substantial feature of this solution is that the tube is closed on the outlet side not by a releasable cover placed thereon with the interposition of a packing preventing heat transmission, but by an uncooled plate to be welded on.

This plate forms a considerable face which is heated by the flue gases. Heat passes through the welded joint into the wall of the tube or into that of the cylindrical collecting chamber and heats the latter. Due to this construction, temperatures up to 150° C. and above are obtained on the collecting-chamber wall, as shown by measurements.

The sleeve is advantageously so proportioned and welded on the tube so far forward that the entire end region of the fuel-gas flues running in the tube is also covered. Advantageously, the heating boiler can be designed so that in the region of the collecting chamber the tube is provided with an inwardly pointed curved bead and the sleeve with an outwardly pointed curved bead.

The overlapping of the tube end into the region of the fuel-gas flues guarantees that the U-shaped profile forming the fuel-gas flues supply heat in the direction of the collecting chamber. Thereby, also, the collecting-chamber wall absorbs additional heat also at low boiler water temperature, so that is has a substantially higher temperature than the directly water-cooled heating faces. No condensate due to combustion gases is therefore formed.

The curved beads on the tube and on the sleeve afford the advantage that these parts necessarily become exactly circular in cross section upon attachment of the beads and also maintain this shape.

The sleeve rests on the topside of the tube. Underneath, it forms together with the tube a gap which is important because the tube is heated more strongly at the top than at the bottom. If, therefore, the sleeve lies at the top, more heat will be carried in the upper region from the tube to the sleeve and from the sleeve to the boiler water. Underneath, the gap forms a resistance to the heat influx. The tube will therefore emit less heat in the lower region to the sleeve and less heat will thus be extracted from the tube.

The problem can be solved also in another way, namely, by the fact that the sleeve is arranged in the collecting chamber of the tube with the formation of an annular hollow space and is connected with its peripheral edge remote from the outlet to the inner wall of the tube at least by contact and is connected at its peripheral edge on the outlet side to the closure plate of the tube in a heat-conducting manner.

A further and preferred solution consists in that the sheet-metal profiles of the fuel-gas flues are provided with cut-outs at the end on the outlet side and in that, with the formation of a gap towards the inner face of the tube, the sleeve is pushed into the cut-outs for heat-conducting contact with the sheet-metal profiles and the gap is filled with a heat-resistant and corrosion-resistant packing means, whereby the sleeve together with the water-cooled tube section surrounding the flue-gas collecting chamber encloses a hollow space.

A substantial feature of this alternative solution is that the sleeve is in direct heat-conducting contact with the sheet-metal profiles which form the fuel-gas flues and the sleeve has no direct contact with the water-cooled wall of the tube. The sleeve can thereby consequently be heated up very quickly.

BRIEF DESCRIPTION OF DRAWING

The heating boiler according to the invention is described in detail hereinafter by reference to two exemplary embodiments illustrated in the drawing wherein.

DETAILED DESCRIPTION

Figure 1:
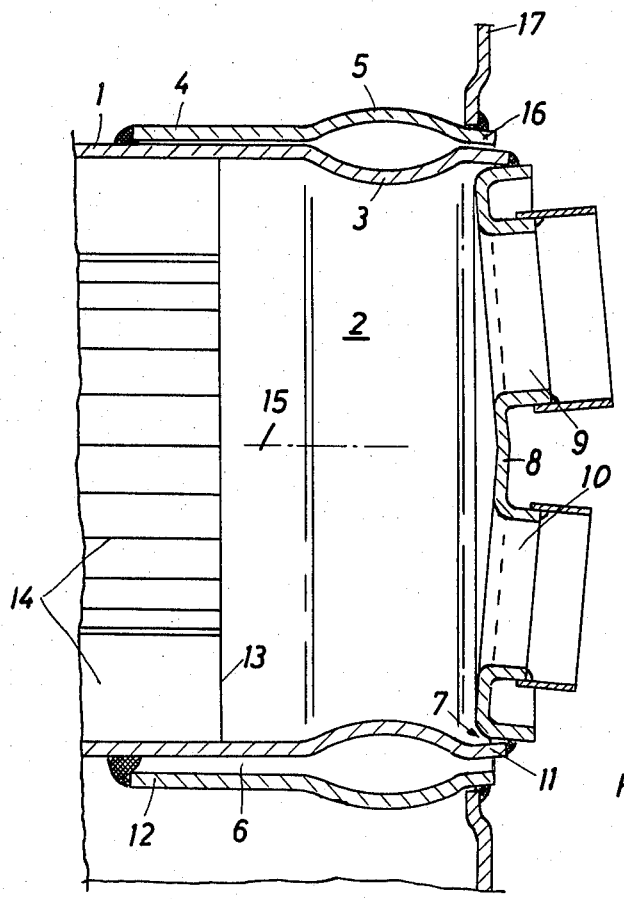
FIG. 1 is a section through a region of the collecting chamber according to the preferred embodiment of the invention.

In FIG. 1, a cylindrical tube is designated as element 1 and 2 denotes a collecting chamber which lies behind the end 13 of the fuel-gas flues 14 and which is closed on the outlet side with a closure plate 8. Plate 8 is inserted into the end opening 7 of the tube 1 and is welded to the peripheral edge 11 thereof. Plate 8 has flue-gas connections 9 and optionally also a cleaning opening 10. In the region of the collecting chamber 2, the tube 1 is provided with an inwardly pointed curved bead or bulge 3 and the sleeve 4 is provided with an outwardly pointed curved bead or bulge 5. With its peripheral edge 16 on the outlet side, the sleeve 4 is welded to the rear wall 17 of the heating boiler and with its peripheral edge 12 remote from the outlet of the tube 1, the sleeve 4 of larger diameter is placed eccentrically onto the end of the tube 1 with a gap 6 increasing in size in downward direction.

In a further advantageous form of construction, however, the heating boiler can be designed so that the peripheral edge 11 of the tube 1 is connected in the upper region above the longitudinal axis 15 of the tube at least at some points to the adjacent peripheral edge 16 of the sleeve 4 or of the boiler rear wall 17 in a heat-conducting manner. The importance of this is that in case of overheating of the tube 1 in the upper region the heat can flow to a certain degree via this thermal bridge into the cooled boiler rear wall 17.

Figure 2:
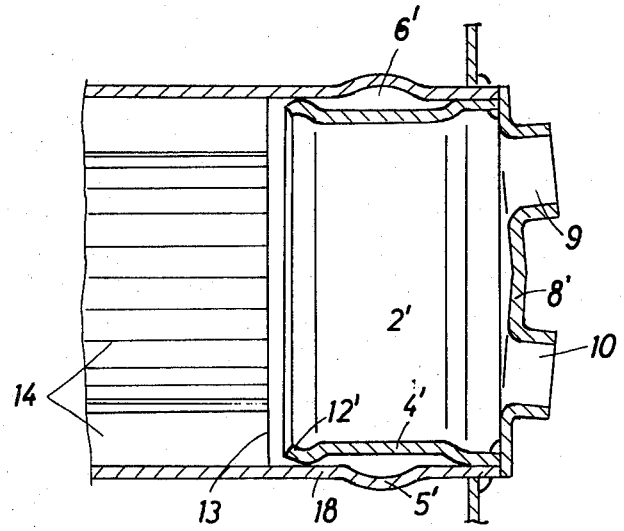
FIG. 2 is a section through the region of the collecting chamber according to a second embodiment.

In the exemplary embodiment according to FIG. 2, the sleeve 4' is not pushed over the tube 1, but is inserted into the tube 1 and connected in a heat-conducting manner to the closure plate 8', at least touch contact of the peripheral edge 12' with the collecting-chamber wall 18 being provided. With this solution the tube 1 can also be provided with a continuous curved bead 5' to form a larger hollow space 6' between the sleeve 4' and tube 1.

Figure 3:
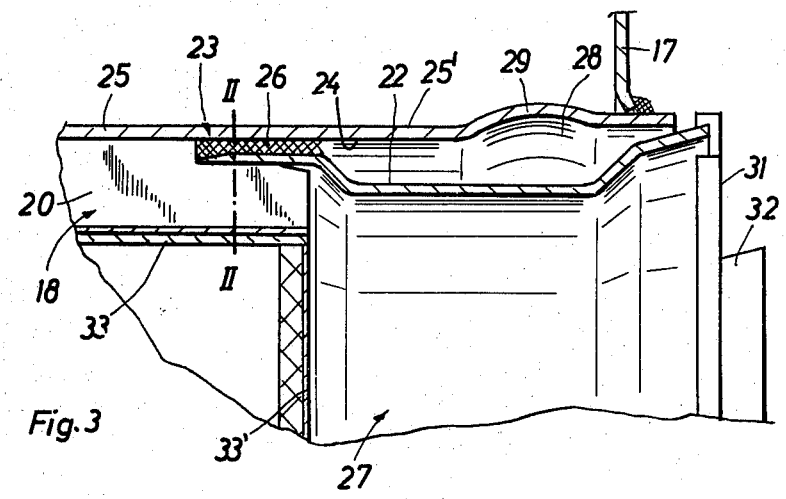
FIG. 3 is a section through the region of the flue-gas collecting chamber according to the third embodiment.
Figure 4:
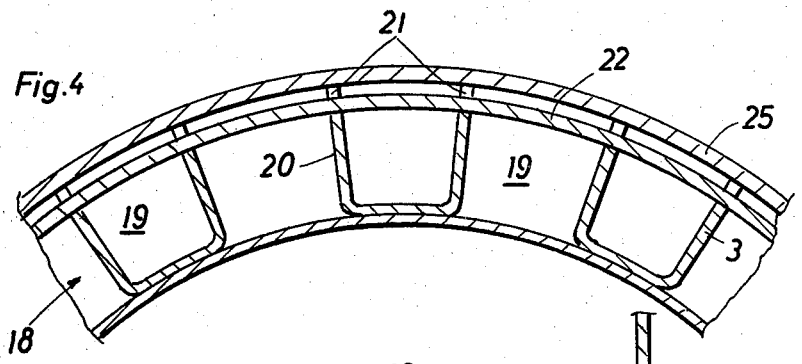
FIG. 4 is a section along the line IV—IV in FIG. 3.
Figure 5:
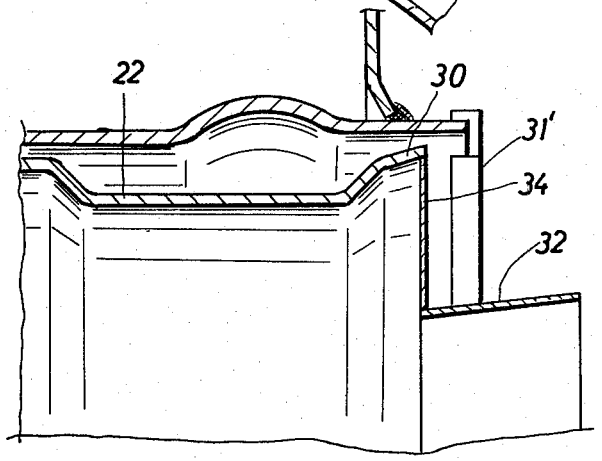
FIG. 5 is a section corresponding to FIG. 3, but with a different closure on the flue-gas side.

According to FIGS. 3 to 5 which show another preferred embodiment, the U-shaped sheet-metal profiles 18 which form the fuel-gas flues 19 and are welded onto the inner face 24 of the tube 25, all around the same according to FIG. 4, are provided with cut-outs 21 at the end 20 on the outlet side, the sleeve 22 arranged in the flue-gas collecting chamber 27 being pushed tightly onto the bottoms of the cut-outs 21 in a heat-conducting manner. The cut-out depth and sheet thickness of the sleeve 22 are proportioned so that there is obtained towards the inner face 24 of the tube 25 a gap 23 in which a heat-resistant and corrosion-resistant packing means 26 is introduced, in order, on the one hand, to form a heat-transmission barrier to the inner face 24 of the cooled tube 25 and, on the other hand, to prevent fuel gases from flowing out into the hollow space 28 between the sleeve 22 and the tube section 25'.

The tube section 25' is provided with an outwardly pointed, continuous curved bead 29, in order to enlarge the hollow space 28.

The combustion chamber 33 provided with a rear wall 33' rests concentrically, supported by the sheet-metal profiles 18, in the tube 25.

According to FIG. 5, the sleeve can be connected at its rear peripheral edge 30 in a heat-conducting manner to a relatively thin closure cover 34 which has a flue-gas outlet connection 32 and optionally a cleaning opening (not shown). This cover 34 likewise transmits its absorbed heat to the sleeve 22. Nothing stands in the way of the arrangement of an additional closure cover 31' which has corresponding openings for the passage of the connection 32 and for cleaning. Apart from that, a releasable closure cover 31 can, of course, also be provided according to FIG. 3.

I claim:

1. A heating boiler comprising a water jacket including front and rear walls, fuel flues, tube and sleeve means, said tube means extending through said walls and enclosing said flues and defining a combustion chamber and a collecting chamber, one of said means, in the vicinity of said collecting chamber, encircling the other of said means and defining an annular gap therewith, at least one of said means having a bulge adjacent said gap to increase the size of the gap between said means, and closure means on one of the first said means to obturate said collecting chamber, said rear wall having a thermally conductive connection with said one means which encircles said other means.

2. A heating boiler as claimed in claim 1 wherein the tube means and sleeve means include corresponding peripheral edges adjacent the collecting chamber and the sleeve means includes a further peripheral edge remote from the first said peripheral edge thereof, the remote peripheral edge having thermally conductive engagement with said tube means.

3. A heating boiler as claimed in claim 1 wherein the said closure means has a thermally conductive connection with said one of the first said means.

* * * * *